United States Patent [19]

Dockins, Jr. et al.

[11] Patent Number: 4,712,615

[45] Date of Patent: Dec. 15, 1987

[54] LINER HANGER ASSEMBLY WITH SETTING TOOL

[75] Inventors: Roy R. Dockins, Jr., Orange, Calif.; Hiram E. Lindsey, Jr., Midland, Tex.

[73] Assignee: Lindsey Completion Systems, Midland, Tex.

[21] Appl. No.: 881,053

[22] Filed: Jul. 1, 1986

[51] Int. Cl.[4] ..... E21B 23/00; E21B 43/10

[52] U.S. Cl. ..... 166/208; 166/215

[58] Field of Search ..... 166/208–212, 166/214, 215, 217, 123–125, 136–138

[56] References Cited

U.S. PATENT DOCUMENTS

| | | | |
|---|---|---|---|
| 3,012,612 | 12/1961 | Wright et al. | 166/208 |
| 3,285,345 | 11/1966 | Solum | 166/208 |
| 3,570,599 | 3/1971 | Wilson | 166/208 |
| 4,096,913 | 6/1978 | Kenneday et al. | 166/208 |
| 4,497,368 | 2/1985 | Baugh | 166/208 |
| 4,603,743 | 8/1986 | Lindsey, Jr. | 166/212 |

*Primary Examiner*—Stephen J. Novosad
*Assistant Examiner*—Bruce M. Kisliuk

[57] ABSTRACT

A setting tool and liner hanger where the liner hanger has a threaded release section and elongated slip slots for receiving slips. The slips have inclined tongue and groove interconnections along the sides of the slots defining expander surfaces. The setting tool has a hydraulic actuator and a mechanical actuator respectively having dog members releasably connected to upper and lower internal grooves in the slip members. The hydraulic actuator operates in response to hydraulic pressure for moving connected dog member for setting the slips in a well casing.

Upon release of the coupling nut on the setting tool from the liner hanger, the mechanical actuator is deactuated and both dog members are released from the slips so that the setting tool is releasable from the liner hanger.

The mechanical actuator operates in response to relative rotation between the setting tool mandrel and liner hanger for moving connected dog members and the slips to a setting condition. The tool is raised to a location to set the slips and to release the setting tool from the liner hanger.

17 Claims, 15 Drawing Figures

LINER HANGER ASSEMBLY WITH SETTING TOOL

FIELD OF INVENTION

This invention relates to setting tools and liner hangers for setting liners in well bores traversing earth formations, and more particularly, to setting tools and liner hangers which can be selectively mechanical or hydraulically set and incorporate the operating mechanisms with a setting tool, and improved slip means with a liner hanger.

BACKGROUND OF THE PRESENT INVENTION

In the drilling, or completion of wells traversing earth formations, the first section of borehole is drilled from the earths surface to a selected depth and lined with a tubular pipe which is cemented in place and commonly referred to as a surface casing. In the next succeeding section of borehole drilled, a tubular pipe commonly called a liner is lowered into the borehole. The top of the liner is coupled to a liner hanger and the liner hanger is releasably connected to a setting tool. The setting tool is connected to a work string or drill pipe which lowers the liner into the open borehole below a casing until the liner hanger is adjacent to or near the lower end of the casing and the lower end of the liner is above the bottom of the open borehole. The liner carries conventional cementing equipment such as a cementing shoe, float collars and plug catchers. The borehole is filled with liquid such as drilling mud which is bypassed around the liner and liner hanger as the liner is run in the borehole. For a number of reasons it is desirable to have the outside of the liner or its diameter as large as possible to pass through the casing and the inside diameter of the liner hanger and liner which remains in the borehole as large as possible. Thus, as additional liners are disposed in drilled sections of a well bore the size and length of the additional liners can be maximized enabling larger downhole liner bores at greater depths from the earths surface. In other words it is desirable to minimize the effective annular wall thickness of a liner hanger as well as minimize the components of the liner hanger left with the liner in the well bore after the setting tool is released from the liner hanger and retrieved to the surface.

When the liner reaches a desired location in a well bore and upper casing, the setting tool is actuated to move slips or slip members on the liner hanger between a retracted position to an extended position in engagement with the well casing. When weight is applied to the hanger slips, i.e. the weight of the liner, the slips are set and hang the liner in the well casing. Thereafter, the setting tool mandrel is slacked off ("lowered") and rotated to the right by the drill string to rotate and release a lefthand threaded release nut on the setting tool from the liner hanger. Generally, the setting tool also has a sealing device in sliding and sealing relationship to a bore in the liner hanger or liner after the setting tool is released from the liner hanger. When cement is pumped through the drill string, the liner and the cementing equipment to cement, the annulus between the liner and the borehole receives the cement. Following cementing of the drill string in the open borehole, the setting tool is retrieved and the drilling or completion operations continued.

The setting tool can have hydraulically operated setting means for the hanger slips or can have mechanically operated setting means for the hanger slips. Hydraulically operated setting means typically employ a hydraulic cylinder which is actuated by pressure in the bore of the drill string. Pressure is obtained by dropping a pump down ball through the drill string to seat in a ball valve sleeve in the liner. The ball valve sleeve is shear pinned to the liner and seats the ball so as to close off the bore of the valve sleeve. Thus, fluid under pressure, is then used to actuate the hydraulic cylinder to set the hanger slips. When the hanger slips are set, an increase in pressure permits shearing of the shear pin in the ball valve sleeve releasing the valve and opening the bore for subsequent application of cement.

In a mechanically set liner hanger, it is necessary to obtain a relative downhole rotation of parts to release the hanger slips or a force spring which acts upon the slips. The effect of a force spring upon release of the slips is the move the slips upwardly relative to an expander so that the slips also move outwardly. The hanger slips are then one-way acting in that the hanger and liner can be raised or lifted upwardly but a downward motion sets the slips to hang the liner in a well casing.

Hydraulic and mechanically operated devices have been separately incorporated in a well hanger and setting tool so that either type of setting device could be used for hanging a liner. The use of two different devices in a setting tool and liner hanger is desirable as trips in a well bore are expensive and time consuming. Thus, if the hydraulic mechanism fails or if resetting of a liner is contemplated, selective use of mechanical or hydraulic actuating means is desirable. However, such devices have heretofor required incorporation of parts of the actuators in the liner hanger.

The present invention is concerned with a hydraulic and/or mechanical setting tool where the setting tool carries substantially all of the actuating equipment for retrieval with the setting tool and the liner hanger has a slip design which minimizes the annular wall thickness of the liner hanger and has substantial strength for supporting heavy and long liners.

THE PRESENT INVENTION

The present invention is embodied in a liner hanger for a liner in which the liner hanger has an internally, left hand thread for a releasable connection to release nut on a setting tool. In the liner hanger are elongated, vertically disposed slip elements circumferentially disposed about the liner hanger in elongated slots. The elongated slots have an upper end surface which is inclined to form an expander surface. Along the each side of a slot are inclined tongue and grooves which are inclined at a similar angle as the inclination angle of expander surface. The elongated slips or slip members have an outer serrated surfaces for engagement with a wall casing. The upper inner end of a slip member is complementarily inclined to match the inclination of the expander surface. Along each longitudinal side of a slip are tongue and grooves which are arranged to interfit with and be slidably received in the tongue and grooves along the sides of a slip slot. Thus, the slips have side surfaces and an end surface which are load bearing with respect to the hanger and provide a substantial load support for a liner. In addition, the slips in a contracted position within the liner hanger have the outer serrated surface below the outer surface of the liner hanger and provide a thin wall annular construction of the hanger.

The setting tool includes a setting tool release nut with an external lefthand thread for releasably connecting the setting tool to the liner hanger. The release nut is slidably and non-rotatably mounted on an tubular inner member of the setting tool. Also, at the lower end of the inner member is a sealing assembly arranged for a sliding and sealing relationships with the liner hanger bore and as well as a ball sleeve valve which is shear pinned to the inner member. The sleeve valve is sized to receive a sealing ball for hydraulic operation of the setting tool.

The one embodiment, when the hydraulic actuator is operated, upper dog members on the setting tool set the slips on the liner hanger by hydraulically pressure applied to move the upper dog members and the slips upwardly and outwardly on the slip expander and tongue and groove surfaces. Upon rotation of the inner member to operate the release nut, the release means for the mechanical actuator is actuated releasing the spring force on a lower set of dog members. Upon upward movement of the inner member, both the upper and lower dog members are disabled and the setting tool and actuators are removable with a setting tool from the liner hanger leaving only the hanger slips and the hanger in the borehole.

When the mechanical actuator is operated independent of the hydraulic actuator, the actuation is by relative rotation between the liner hanger and the inner member of the setting tool. One way to obtain relative rotation is to set the liner on the bottom of the bore hole. Upon relative rotation, the spring force is released and applied to the lower dog members moving the slip members upward and outwardly into contact with the well bore. Thereafter the inner member can elevate the liner hanger to the desired located where downward movement of the liner sets the slips and the liner hanger.

In another embodiment of the setting tool, the release nut is located at the upper end of the liner hanger and the upper end of the liner hanger and the upper and lower dog members are disabled by engagable surfaces on the inner member of the setting tool.

DESCRIPTION OF THE INVENTION

Figure 1:
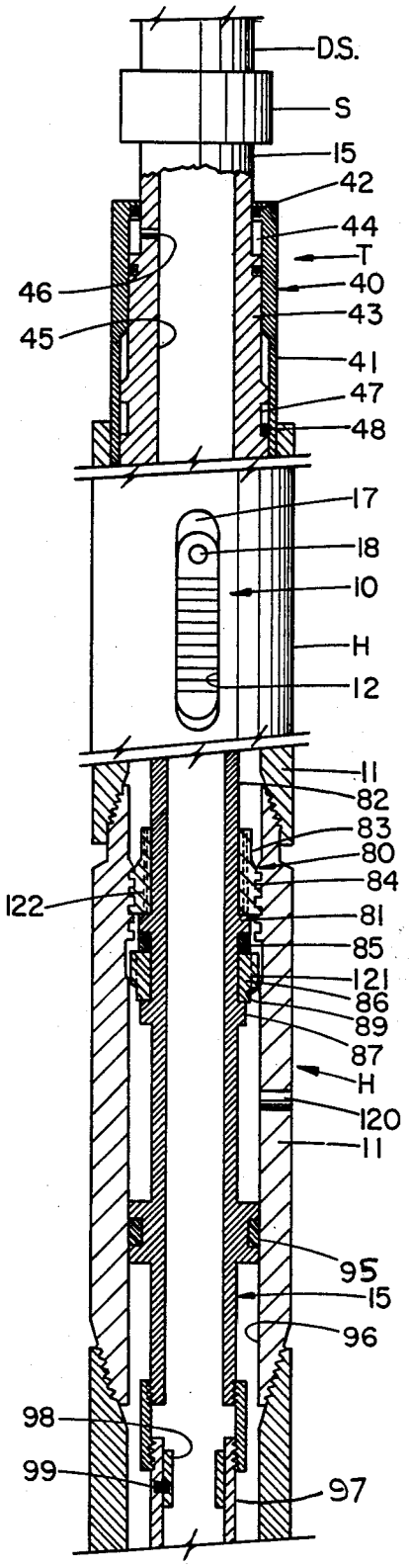
FIG. 1 is a longitudinal view partially in cross-section of a setting tool and liner hanger.
Figure 2:
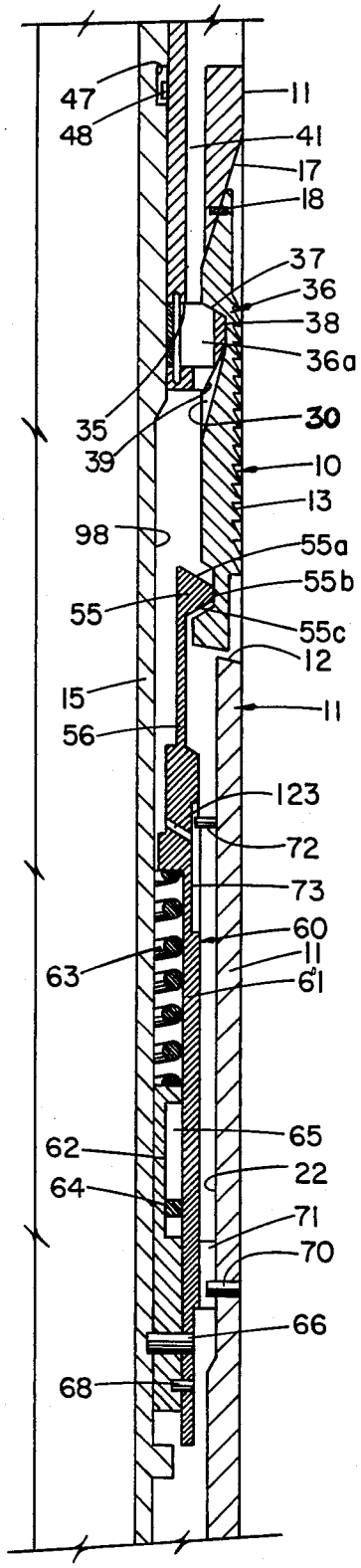
FIG. 2 is a longitudinal view partially in cross-section of the setting tool and liner hanger in relation to the slips and dog members.

Referring now to FIG. 1 and FIG. 2, a liner (not shown) is connected at its upper end to a liner hanger H where the liner hanger H has longitudinally extending slip members or slips 10. The slips 10 are circumferentially disposed about an outer member 11 of the liner hanger and located within elongated slots or recesses 12. In an initial contracted position of the slips 10, the outer serrated surfaces 13 of the slips 10 are located below the outer cylindrical surface of the outer member 11. In an extended position of the slips 10, the outer serrated surfaces 13 engage the wall of a well casing (usually near the lower end, of an in-place liner or casing), and can suspend or hang the liner on a well casing so that the liner extends through an open borehole with its lower end preferably located above the bottom end surface of the well bore.

The liner and liner hanger H are lowered into a well bore by a setting tool T which releasably interconnects with the liner hanger H and is coupled to a drill string DS by a Sub S. The setting tool T has a tubular inner member 15 which carries a hydraulic actuating means 40, and a releasable interconnecting means 80 (FIG. 1). Also, on a lower end of the inner member 15 is a seal means 95 for providing a sliding and sealing relationship with a bore 96 in the outer member 11 and a lower pipe section 97 of the inner member 15. In the lower pipe section 97 is a tubular sleeve ball or plug catcher 98 connected by a shear pin 99 to the inner member 15 so that a ball or plug (not shown) can be dropped through the inner member 15 to seal off the bore of the pipe section 97 and permit development of a hydraulic pressure to actuate the hydraulic actuating means 40.

In the present invention, the slips 10 can be set either hydraulically or mechanically and the entire setting tool apparatus is retrievable, leaving only the liner and the liner hanger H in the well bore after cementing the liner in place where the liner hanger has slip elements incorporated with the wall of the liner hanger.

Referring now to FIG. 1 and FIG. 2, the slips 10 are elongated members which are received in longitudinally extending slots 12 and are keyed and retained relative to a tubular outer member 11 in a manner to be discussed later. The slips 10 have outer serrated gripping surfaces 13 which are initially within the circumferential outer surface of the outer member 11. The slips 10 and the slots 12 are circumferentially disposed about the circumference of the outer member 11 and may be three or four or more in number with generally equi-distant angular spacing. The upper end of an elongated slot 12 has an inclined surface 17 which together with a slip keying arrangement defines an expander means. A slip 10 is initially retained in position relative to the inclined surface 17 by a shear pin 18. When the shear pin 18 is sheared, a slip 10 slides upwardly and outwardly on an inclined surface 17.

Figure 3:
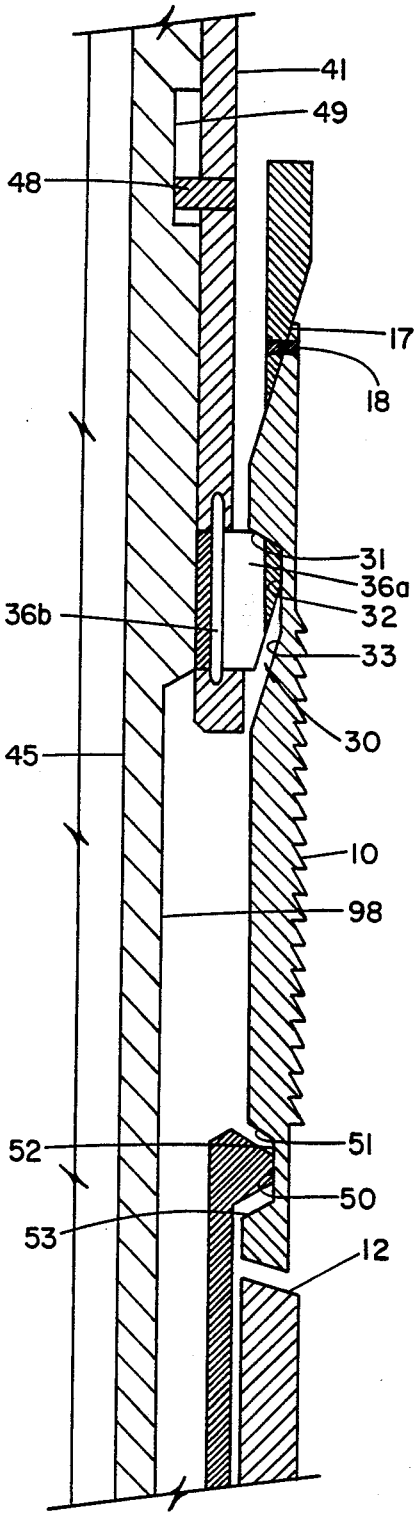
FIG. 3 is a longitudinal view partially in cross-section of the slips and dog members.

As shown in FIG. 2 and FIG. 3, each slip 10 has an upper internal and transverse groove 30. The upper groove 30 has an upper inclined surface 31 which joins a vertical surface 32 which joins a lower inclined surface 33 which is at the same angle of inclination as the expander surface 17. The angle of inclination is 15 degrees. A cylindrical housing 41 which is slidably mounted on the inner member 15 has rectangularly shaped dog slots 35 disposed adjacent to the upper grooves 30 in the slips 11 where the dog slots 35 respectively receive upper dogs or dog members 36. The upper dogs 36 are slidably secured in the housing 41 by elongated slots 36a in the dogs 36 and elongated vertical pins 36b in the slots 36 where the pins 36b are attached to the housing 41. Each upper dog 36 has an upper complementary formed surface 37 for engaging the upper inclined surface 31 of a groove 30 in a slip 10. The upper surface 37 of a dog 36 joins a vertical surface 38 which is shorter in length than the vertical surface 32 in a slip groove 30 and the vertical surface 38 joins an lower inclined surface 39 which is complementary to but spaced from the inclined surface 33 in a slip groove 30. As shown in FIG. 2, when a dog 36 is fully extended relative to the housing 41, the pin 36b is at the left hand side of the opening 36a in the dog 36. In operation, when the dogs 36 are moved upwardly with the housing 41 relative to the outer housing 11, the dogs 36 engage and cause the slips 10 to shear the pins 18 and engage the slips 10 with a well casing.

Figure 4:
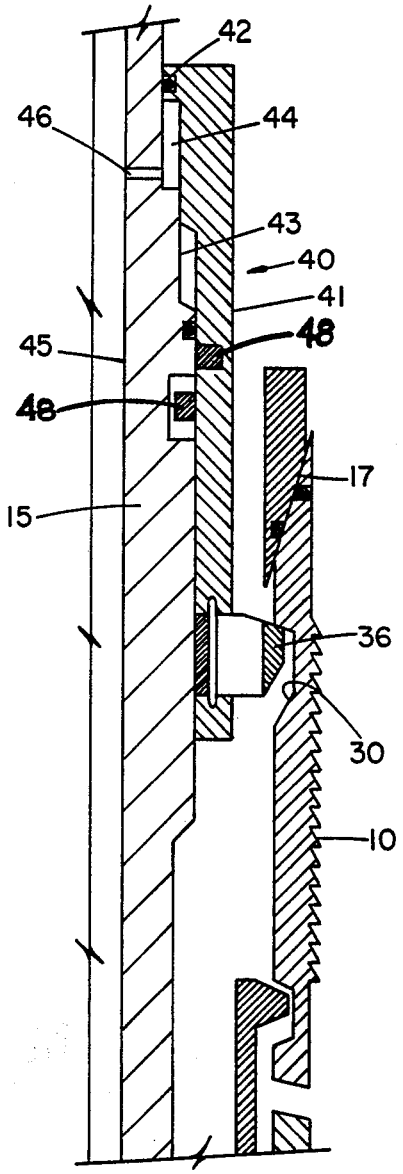
FIG. 4 is a longitudinal view in partial cross-section of the slips when set hydraulically.

The hydraulic cylindrical housing 41 is slidably mounted on the inner member 15 and has an inner flange 42 slidably and sealing received on the inner member 15. The inner member 15 has an enlarged diametrical section 43 which slidably and sealingly receives an inner surface of the hydraulic cylindrical housing 41. Between the sealed portions is an annular chamber 44 which is connected to the bore 45 of the inner member 15 by a port 46. The inner member 15 has an annular locking recess 47 which receives a shear pin 48 for preventing premature setting of the tool. When hydraulic pressure is applied to the chamber 44 via the port 46, the housing 41 is moved upwardly relative to the outer member 11 to shear the pin 48 and to set the slips 10. (See FIG. 4)

In the foregoing description, the setting tool and liner hanger are hydraulically set. In cases of malfunction and for other reasons, it may be desirable to alternatively set the liner hanger H mechanically while the liner and setting tool are in the well bore. In setting the slips mechanically, the liner is brought into engagement with the bottom of the well bore by lowering through the well bore on a drill string and attached setting tool. When the liner engages the bottom of the well bore, the liner is relatively stationary so that relative rotation between the liner and the setting tool T can be obtained.

Figure 5:
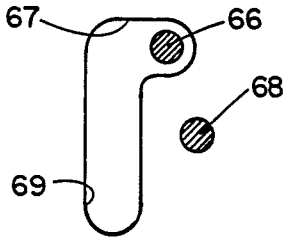
FIG. 5 is a plan view of a j-slot and J-pin for interconnecting mechanical actuator to a setting tool.

Referring to FIG. 2, at the lower end of the inner member 15 is a telescopically arranged spring sleeve actuator assembly 60 which includes an outer tubular sleeve 61 and an inner tubular sleeve 62. The sleeves 61, 62 have facing surfaces which engage a spring 63. In the position of the sleeves 61, 62 illustrated, the spring 63 is under compression. A coupling pin 64 on the outer sleeve 61 is received in an annular recess 65 in the inner sleeve 62 for coupling the sleeves 61, 62 to one another while permitting relative longitudinal and rotational movement. The sleeves 61, 62 are prevented from relative longitudinal movement initially by a J pin 66 in a horizontal locking slot 67 (See FIG. 5) which positions the sleeves 61, 62 to one another in a first position and a shear pin 68 initially prevents rotation movement of the pin 66 in the locking slot 67.

The outer sleeve 61 is releasably locked against rotation relative to the outer member 11 by a guide pin 70 received in a vertical guide slot 71 on the outer member 11. The outer member 11 also has a guide and shear pin 72 received in a longitudinal slot 73 in the outer sleeve 61 to maintain positional alignment of the sleeve 61 relative to the slips 10. When the setting tool is removed from the liner hanger, the pin 72 is sheared.

Upon relative rotation between the inner sleeve 62 and the outer sleeve 61, the J-pin 66 is moved into alignment with a longitudinal slot 69 (FIG. 5) after the shear pin 68 is sheared. When the J-pin 66 is in the longitudinal slot 69, the spring 63 moves the outer sleeve 61 upwardly relative to the inner sleeve 62.

A slip 10 has a lower dog recess 50 (FIG. 3) which has an upper inclined surface 51 which adjoins a vertical surface 52, the vertical surface adjoining a lower inclined surface 53. The vertical width of the recess 50 is greater than the vertical width of a lower dog 55 in the recess 50. The lower dog 55 has complementary inclined and vertical surfaces 55a, 55b and 55c (See FIG. 2) and is attached by a flexible collet finger 56 to the outer sleeve 61. The finger 56 is formed by vertical slots between the lower dogs 55 and a cylindrical base on the outer sleeve 61. Thus, the fingers 56 are flexible inwardly from the position shown in FIG. 2 and FIG. 3.

Figure 6:
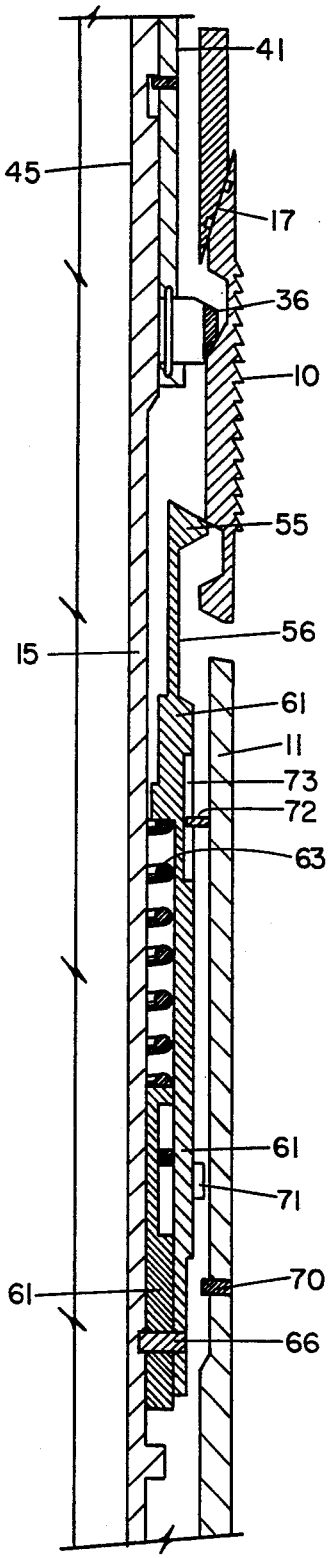
FIG. 6 is a longitudinal view in partial cross-section of the slips when actuated mechanically.

In operation, when the liner is lowered to engage the bottom of the well bore, rotation of the drill string DS shears the pin 68 and unjays the J-pin 66 in the J-slot in the outer sleeve 61 so that the spring 63 may produce relative upward movement of the outer sleeve 61. Relative upward movement of the outer sleeve 61 moves the lower dog 55 upwardly and moves the slips 10 toward a slip setting position.(See FIG. 6). During this motion the upper dog 36 is stationary. Thereafter, the inner member 15 of the setting tool is raised by the drill string and the slips 10 can be dragged along the well bore to the location where the liner is to be set. At the location for setting the liner hanger, the drill string is lowered and the slips are set by the expander surfaces 17 and the liner is hung in the well casing. Thus, the lower dog 55 and spring operated mechanism 60 constitute independent means for mechanically setting the slips 10.

The setting tool T and the liner hanger H are releasably interconnected as shown in FIG. 1. The inner member 15 has a flange 81 located below a non-circular section 82 on the inner member 15. A release nut member 83 is slidably and non-rotatively received on the non-circular section 82. The release nut 83 has an outer external left handed thread 84 which is threadedly received in a internal threaded section in the outer member 11. The lower surface of the release nut 83 engages the upper surface of the flange 81 to support the weight of the liner on the inner member 15. Below the flange 81 is a rotational bearing 85 and a rotatable landing sleeve 86 which are disposed between the flange 81 and a lower flange 87. The landing sleeve 86 is sized to have a downwardly facing surface engage an upwardly facing surface 89 in the outer member 11. Below the lower flange 87, the inner member 11 has a sealing means 95 arranged for sliding and sealing relationship with a bore 96 in the hanger H.

To release the connection of the setting tool from the liner hanger, the liner hanger H is set or hung either hydraulically or mechanically as described above. If the hanger is set hydraulically, the shear pin 48 is sheared and the upper dogs 36 move the slips 10 upwardly and outwardly and the lower grooves 50 in the slips 10 move longitudinally relative to lower dogs 55 on the resilient fingers 56. Thereafter, the drill string DS is lowered to set the slips and the rotated to the right to release the nut 83 from the outer member 11. The weight of the liner is on the set slips 10 of the liner hanger. At the time that the drill string is rotated, the spring actuating means is unlocked by the right hand rotation of the J-pin 66 relative to the J-slot and shearing of the pin 68. This releases the compressed spring force in the spring actuating means. Upon upward movement of the drill string DS thereafter, a relieved diametrical portion 98 on the inner member 15 is brought under the upper dogs 36 and the lower dogs 55 are flexible inwardly. The upper dogs 36 are moved inwardly and out of engagement with the upper slip grooves 30 when the relieved portion 98 is under the dogs 36. The pin 72 is also sheared. The lower dogs are free of the lower grooves and the entire assembly can be released from and retrieved from the liner hanger. If the liner is set mechanically, upward movement of the drill string, DS shears the pin 48 and brings the relieved portion 98 under the upper dogs 36.

Figure 7:
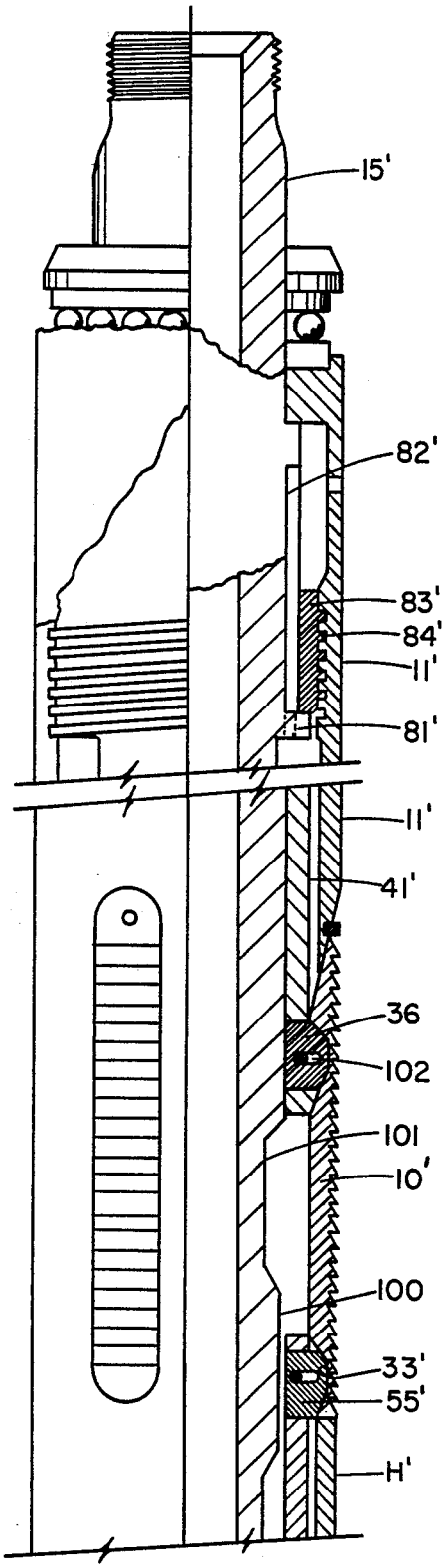
FIG. 7 is a longitudinal view partially in cross-section of a setting tool and liner hanger with a re-arrangement of a release nut and release surfaces for the dog members.

Referring now to FIG. 7, another embodiment of the present invention is illustrated. In FIG. 7, a drill string is connected to the inner member 15' and a liner is connected to the outer member 11'. In FIG. 7, the release nut 83' is located at the upper end of the outer member 11'. The release nut 83' has an external left hand external thread 84' received in a threaded portion of the outer member 11'. As in the other embodiment, a flange 81' on the inner member 15' engages the nut 83' to support the liner and the liner hanger H' on a drill string. The nut 83' is slidably and non-rotatively connected to the inner member by splines 82'. In FIG. 7 the hydraulic actuator and upper dog arrangement are the same as in FIG. 1 except for a minor variation of the pin and slot connection 102 for the upper dog.

Figure 8A:
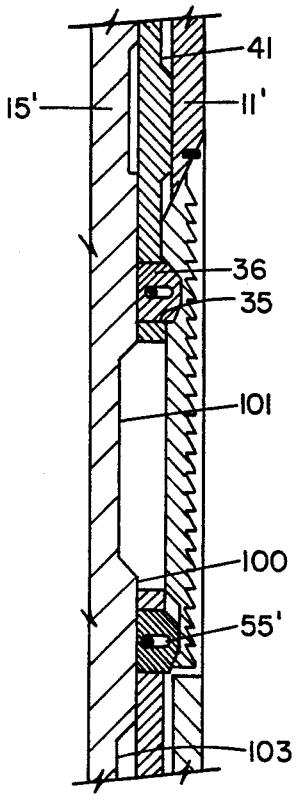
FIGS. 8A–8E are partial views showing slips and setting dogs in (a) a going-in position, (b) a hydraulic setting of slips; (c) release of the mechanical actuator, (d) the position of dog members while the tool is retrieved and (e) a mechanical setting of slips.
Figure 8B:
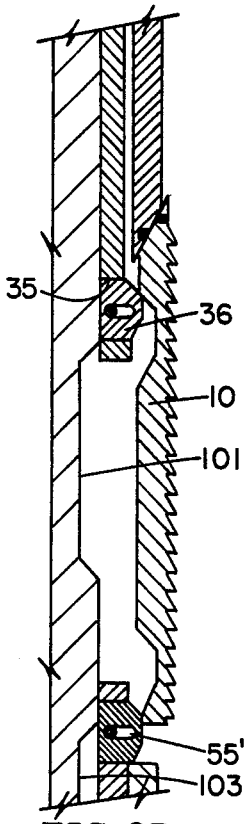
Figure 8C:
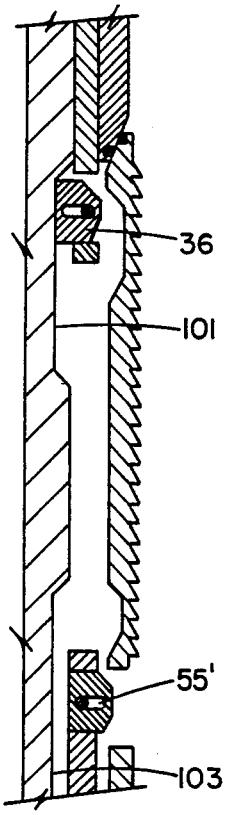
Figure 8D:
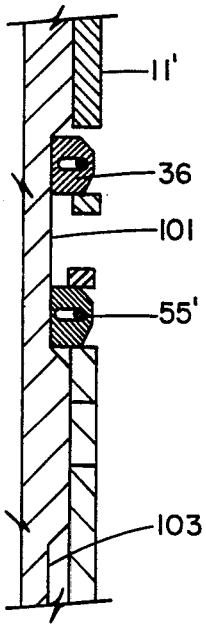

In the lower end of the slip 10', a lower dog member 55' is mounted in a lower slip groove 33' and held initially in position by another external surface 100 on the inner member 15'. The tool of FIG. 7 operates similar to the operation of the tool of FIG. 1. Thus, the going-in position of the dog members 36 and 55' is as shown in FIG. 8A. If the tool is hydraulically set, the slips 10 are set as shown in FIG. 8*b* by hydraulic pressure, (as applied to a pressure chamber 44 shown in FIGS. 1 and 2) to move a cylinder 41 upwardly where the cylinder 41 carries the dog members 36 in elongated slots 35. After setting the slips 10, the drill string DS is lowered and rotated to release the release nut 83'. Then the drill string DS is pulled upwardly to place a relieved portion 101 on the inner member 15' below the upper dogs 36. With rotation the pin 68 is sheared so that the spring actuator means fully extended and the lower dogs 55' are disposed in the recess 103 and remain in the recess 103 (FIG. 8C) until the lower dogs 55' are clear of the outer member 11. At that time, the spring 63 places the lower dogs 55' in the upper recess 101 as shown in FIG. 8D.

Figure 8E:
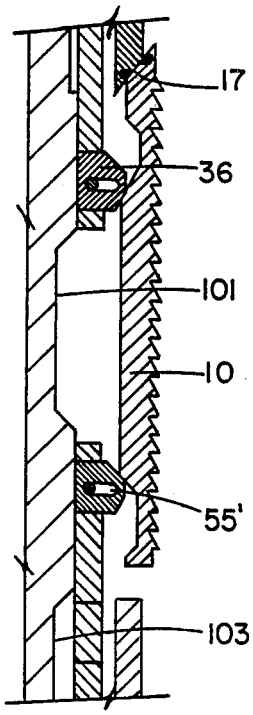

When the hanger H' is mechanically set, the liner is set on bottom and the drill string is rotated to shear the pin 68 and release the spring actuator means for moving the slips 10 with the lower dogs 55' (FIG. 8E) to a setting condition. The setting tool and drill string are then raised to the location where the hanger H' is to be set. The slips while being outwardly extended, do not prevent upward movement of the liner. The liner hanger H' is then set with the slips 10 and expander surface 17 providing the support on the well casing for supporting the liner. The setting of the liner is accomplished by lowering the liner until the slips are firmly set in the well casing. The drill string is raised a short distance to dispose the upper dog in the recess 101 and to dispose the lower dog 55' in the lower recess 103. When the setting tool is pulled free of the liner hanger, the spring disposes the lower dog 55' into the upper recess 101.

Figure 9:
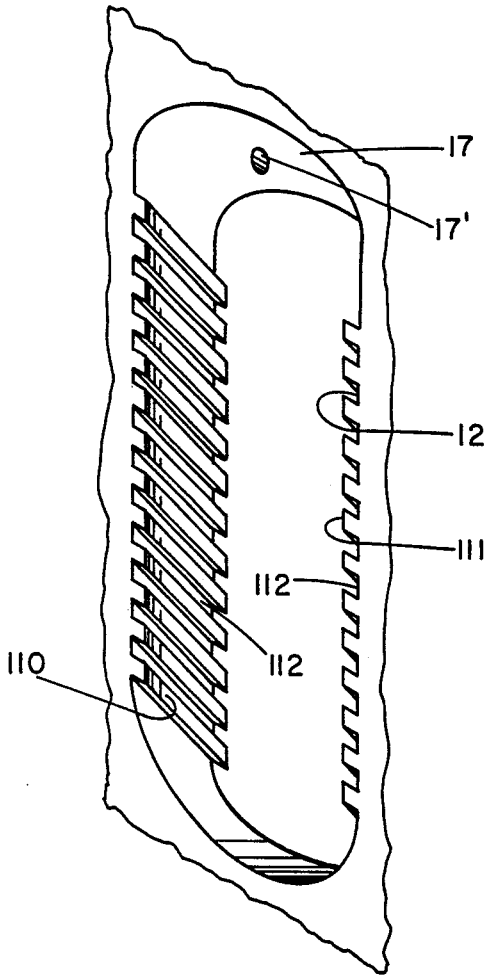
FIG. 9 is a view of a slip pocket with tongue and grooves in the side surfaces.
Figure 10:
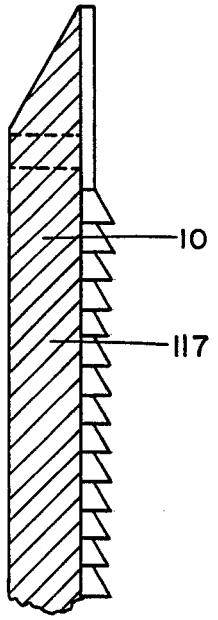
FIG. 10 is an side view of part of a slip element for a slip pocket.
Figure 11:
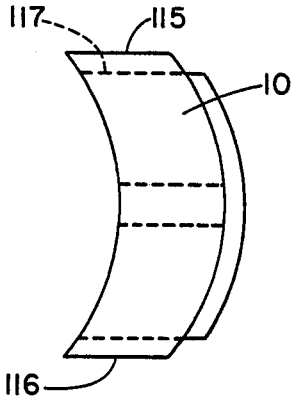
FIG. 11 is an end view of a slip element.

Referring now to FIGS. 9–11, the slips 10 and slip slots 12 are separately illustrated. In FIG. 9, a slip slot 12 is illustrated without a slip element and has the upper expander surface 17 at one end and a threaded opening 17' a for a shear pin. Along each of the parallel sides 110 and 111 of a slip slot 12 are inclined tongue and grooves 112 which are inclined at the same angle as the inclination angle of the expander surface 17. Each slip 10, as shown in FIGS. 10 and 11, has parallel side surfaces 115, 116 with inclined tongue and grooves 117 which are inclined so as to be slidably received in the inclined tongue and grooves of the slip slots 12. Thus, the slips 10 are keyed by a tongue and groove arrangement on each longitudinal side of a slot 12.

Fluid bypass is an important feature for a liner hanger. As shown in FIGS. 1 and 2 the outer member has an access opening 120 above the sealing means 95 for admitting fluid while the hanger is passed through the well bore. The landing sleeve 86 has circumferentially spaced, longitundinal slots 121. Bypass bores 122 are provided in the shoulder 81 and nut 83. A bypass port 123 is provided in the sleeve member 61 and a clearance space is provided between the housing 41 and the outer member 11.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A setting tool and liner hanger for setting a liner in a well bore traversing earth formations including:

a tubular outer hanger member adapted for coupling to a depending liner, said outer hanger member having circumferentially disposed elongated slip openings, elongated slip members disposed in said slip openings for movement of said slip members from a first retracted position within the outer hanger member to an extended position in engagement with the wall of a well casing, a setting tool having a tubular inner member adapted for coupling to a drill string; hydraulic slip setting means for response to hydraulic pressure for producing a slip setting force and mechanical slip setting means for producing a slip setting force, said hydraulic slip setting means and said mechanical slip setting means being carried by said tubular inner member;

coupling means for releasably coupling said tubular inner member to said outer hanger member;

said slip setting means including an upper dog member and a lower dog member which are respectively connected to said hydraulic slip setting means and to said mechanical slip setting means wherein said dog members are movable longitudinally relative to said tubular inner member in response to a slip setting force for moving said slip members from said first retracted postition to said extended position, said hydraulic slip setting means and said mechanical slip setting means for moving said upper and lower dog members respectively including selectively operable actuator means for selectively moving one of said dog members longitudinally relative to said tubular inner member and said outer hanger member.

2. The apparatus as defined in claim 1 wherein said slip openings and said slip members have side surfaces with an inclined and interfitting tongue and groove sliding relationship for providing expander surfaces.

3. The apparatus as defined in claim 2 wherein said slip members do not project outwardly of the outer hanger member in a retracted position of the slip members and are movable to said extended position where said slip members project outwardly of said outer hanger member.

4. The apparatus as defined in claim 1 wherein said slip members have upper and lower locking grooves respectively engagable with said dog members.

5. The apparatus as defined in claim 4 and further including means on said tubular inner member for releasing said dog members from said locking grooves.

6. The apparatus as defined in claim 4 wherein one of said dog members includes spring fingers for resiliently mounting such dog members for relative inward movement.

7. The apparatus as defined in claim 1 wherein said mechanical slip setting means includes a compressed spring for providing a spring force.

8. The apparatus as defined in claim 7 wherein said mechanical slip means includes means for releasing said mechanical slip setting means upon relative rotation between said tubular inner member and said outer hanger member.

9. A liner hanger for anchoring a liner in a well casing including:

a tubular liner hanger member having inner and outer wall surfaces, said liner hanger member having elongated slip openings circumferentially disposed about said liner hanger member, elongated slip members disposed in said slip openings so that side surfaces of said slip members are in facing relationship to side surfaces of said slip openings, and where such facing side surfaces have an inclined and interfitting tongue and groove members for providing a sliding relationship and for providing supporting surfaces between said slip members and said liner hanger member, said slip members having a wall thickness such that in a retracted position of the slip members, an outer surface of a slip member is substantially disposed within the surface circumscribed by said outer wall surface of said liner hanger member, said slip members being slidable by virtue of said tongue and groove members to an extended position in engagement with the wall of a well bore where an outer surface of a slip member is extended outwardly of the outer wall surface of said liner hanger member, and so that an inner surface of a slip member does not project inwardly into the bore of the liner hanger member, said slip members each having groove means in an inner surface arranged for releasable engagement with an actuating member on a setting tool.

10. A liner hanger for anchoring a liner in a well casing including:

a tubular liner hanger member having inner and outer wall surfaces, said liner hanger member having elongated slip openings circumferentially disposed about said liner hanger member, elongated slip members disposed in said slip openings so that side surfaces of said slip members are in facing relationship to side surfaces of said slip openings, and where such facing side surfaces have an inclined and interfitting tongue and groove members for providing a sliding relationship and for providing supporting surfaces between said slip members and said liner hanger member, said slip members having a wall thickness such that in a retracted position of the slip members, an outer surface of a slip member is substantially disposed within the surface circumscribed by said outer wall surface of said liner hanger member, said slip members being slidable by virtue of said tongue and groove members to an extended position in engagement with the wall of a well bore where an outer surface of a slip member is extended outwardly of the outer wall surface of said liner hanger member, said slip members each having groove means in an inner surface arranged for releasable engagement with an actuating member on a setting tool.

11. A setting tool and liner hanger for anchoring a liner in a well casing including a liner hanger outer member adapted for coupling to a depending liner, slip means mounted on said liner hanger for movement between a contracted position and an extended position;

a setting tool having a tubular inner member adapted for coupling to a drill string, independent hydraulic slip setting means responsive to hydraulic pressure for producing a slip setting force, mechanical slip setting means for producing a slip setting force, said mechanical slip setting means being carried by said tubular inner member, coupling means for releasably coupling said tubular inner member to said outer hanger member, means for selectively operating said slip setting means, and means for releasably connecting said slip setting means to said slip means.

12. The apparatus as set forth in claim 11 where said means for releasably connecting said slip setting means to said slip means includes locking grooves and locking dog members.

13. The apparatus as set forth in claim 11 wherein said mechanical slip setting means includes a compressed spring for providing a spring force.

14. The apparatus as set forth in claim 13 wherein said mechanical slip setting means are operable in response to relative rotation between said inner member and said outer member.

15. The apparatus as set forth in claim 11 and further including fluid bypass means between said inner and outer members.

16. The apparatus as set forth in claim 11 and further including a ball catcher valve means connected to said inner member.

17. A setting tool including a tubular inner member adapted for coupling to a drill string; upper and lower independent, slip actuator members on said inner member for providing a force for moving slip members between a retracted and an extended position;

first mechanical actuator means interconnecting said lower slip actuator member to said inner member, said first actuator means including compressed resilient means operable upon release for actuating said lower slip actuator member;

second hydraulic actuator means interconnecting said upper slip actuator member to said inner member including hydraulic means operable upon the application of pressure in the string of drill pipe for actuating said upper slip actuator member, and means on said inner member for effecting a releasable connection of said slip actuator members with respect to said slip members so that said setting tool, said slip actuator members and said actuator means being retrievable as an assembly from a borehole independently of a liner hanger.

* * * * *